United States Patent [19]

Greer et al.

[11] Patent Number: 4,942,815

[45] Date of Patent: Jul. 24, 1990

[54] METER ROLL MOUNTING MEANS

[75] Inventors: Larry J. Greer, Chesterfield; Robert A. Sexton, Manchester, both of Mo.

[73] Assignee: Allied Gear and Machine Company, St. Louis, Mo.

[21] Appl. No.: 268,087

[22] Filed: Nov. 7, 1988

[51] Int. Cl.[5] ..... B41F 31/32; B41L 27/34

[52] U.S. Cl. ..... 101/352

[58] Field of Search ..... 101/350, 348, 329, 330, 101/351, 352, 349, 216, 219, 247, 141

[56] References Cited

U.S. PATENT DOCUMENTS 1,909,326 5/1933 Wheeler, Jr. ..... 101/329

3,364,849 1/1968 Price, Jr. ..... 101/329 X

*Primary Examiner*—J. Reed Fisher

*Attorney, Agent, or Firm*—Ronald W. Hind

[57] ABSTRACT

An assembly (30) for mounting a printing press meter roll (16) to opposed sideframes (12, 14) includes mounting frames (32) each including forwardly disposed bearing (46) receiving the weight of the meter roll and a rearwardly disposed ell-shaped slot (68). The meter roll mounting frames are mounted by pivot pins (60) to adjacent sideframes, said pins being spaced from the axis of the meter roll, and being retained within the slots by a ball detents (72). An elongate counterbalance adjustment screw (62) is pivotally mounted to each sideframe and includes a remote end (82) engageable with the mounting frame below the pivot so that by backing off the screw the meter roll assembly is adjustably swung to a rest position on support pins 90 to move it out of engagement with, and provide access to, the anilox roll. The mounting frames include stud handles (96) to facilitate sliding removal of the mounting assembly from the sideframes.

10 Claims, 1 Drawing Sheet

FIG. 1.
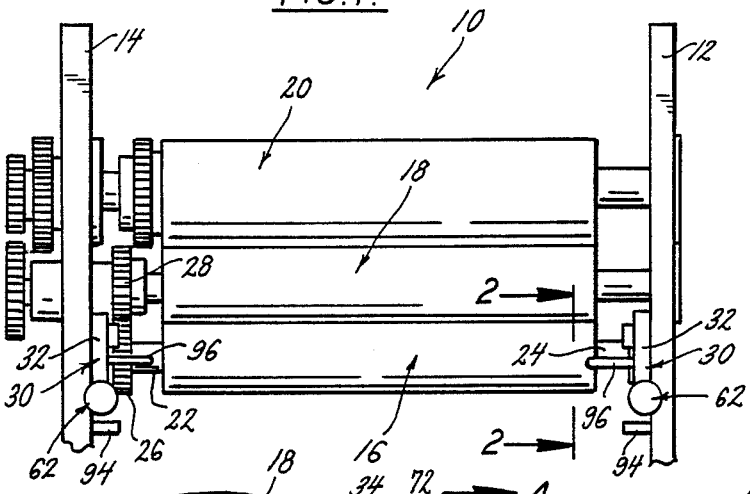
FIG. 6.
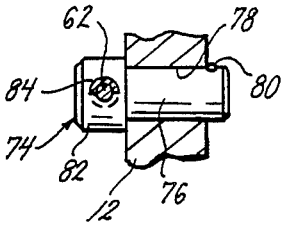
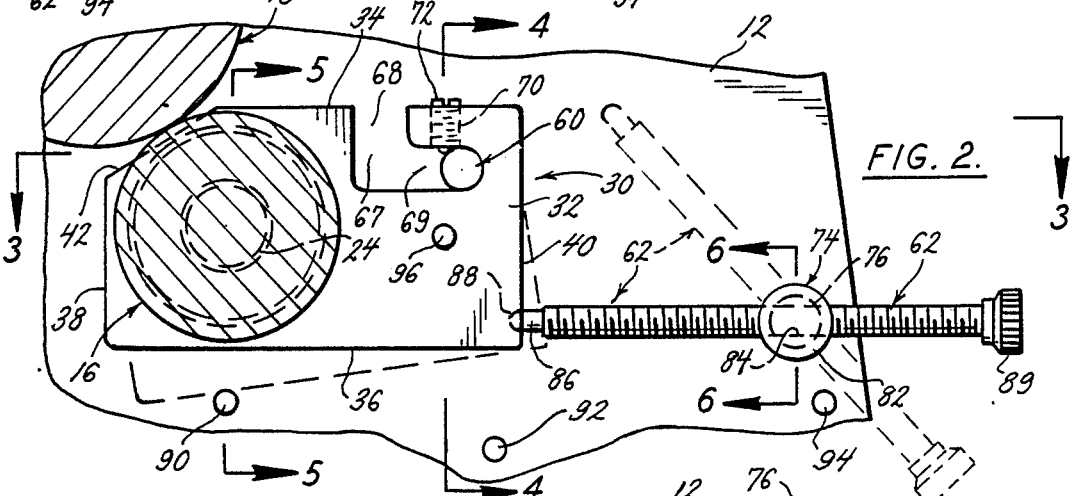
FIG. 2.
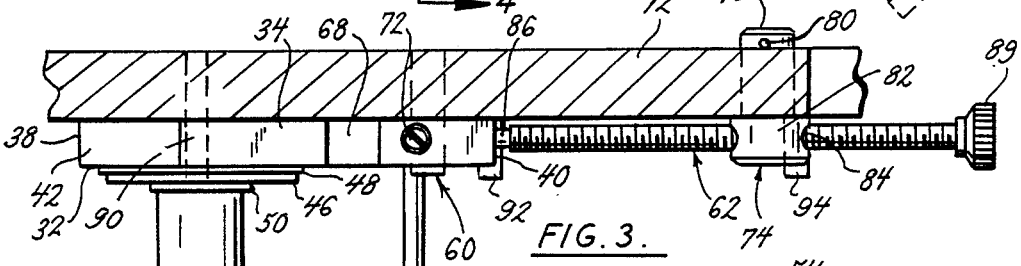
FIG. 3.
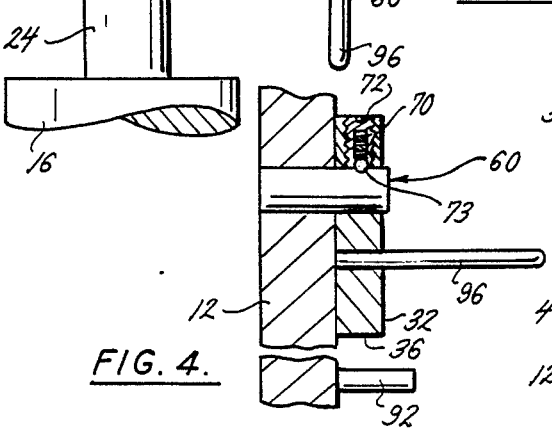
FIG. 4.
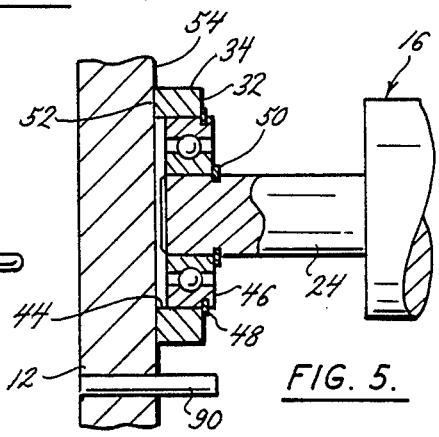
FIG. 5.

METER ROLL MOUNTING MEANS

BACKGROUND OF THE INVENTION:

This invention relates generally to a roll mounting assembly for a printing press and particularly to a mounting assembly which permits adjustment of the position of said roll relative to another roll and which facilitates removal of said roll and access to the other roll.

In a web fed printing press the anilox or ink roll is often provided with a meter roll which engages the anilox roll and transfers ink from a supply reservoir to the anilox roll. The meter roll engagement pressure is adjustable and the roll is covered with a compressible elastomer material to adjust the film thickness of the ink.

Mounting the meter roll to the printing press sideframes presents a problem since the roll must be gear or belt driven and yet retain adjustment flexibility. In addition, conventional meter rolls must be removable in order to service them and in order to gain access to the anilox roll when it requires removal. Although meter rolls exist which do not require removal to gain access to the anilox roll such meter rolls still present a hinderance to the removal of the anilox roll.

This invention overcomes these and other problems in a manner not revealed by the known prior art.

SUMMARY OF THE INVENTION:

This meter roll mounting assembly is provided with mounting frames at each end of the roll which are pivoted to associated printing press sideframes to facilitate adjustment and removal of the meter roll.

The mounting frames each include ell-shaped slots which are received by mounting pins carried by the sideframes, the pins being retained within the slot ends by ball detents. Adjustment screws are mounted to each sideframe which engage and hold the mounting frames in place, the screws adjusting the position of the mounting frame, and therefore the meter roll, to afford access to an adjacent roll and being pivotable clear of the mounting frames and being removed to facilitate removal of said meter roll. The meter roll drive gear is mounted to the meter roll journal end on the inside of the gear frame so that the roll, gear and mounting frames can be removed as a unit.

It is an aspect of this invention to provide a mounting assembly for a secondary roll, such as a meter roll, which is mounted for engagement with a primary roll, such as an anilox roll, having a parallel axis of rotation, which permits the secondary roll to be adjusted and removed and which facilitates access to the primary roll, the secondary roll mounting assembly including a secondary roll having opposed journal ends; opposed side support means at each end of said secondary roll; opposed mounting frames each including bearing means receiving an associated journal end; pin means and cooperating slot means respectively pivotally mounting each mounting frame of said mounting frames to an associated support means of said side support means in spaced relation from said bearing means, one of said pin means and slot means being provided by the respective mounting frame and the other of said pin means and slot means being provided by the associated support means, said pin means being disengageable from said slot means to remove each said mounting frame from said associated support means, and adjustment means between each said associated support means and each respective said mounting frame disposed in spaced relation from said pin means to apply pressure to said mounting frame and control pivoting of said mounting frame about said pin means to swing said secondary roll about said pin means toward and away from said primary roll.

It is another aspect of this invention to provide that each mounting frame includes a side and the slot means includes an ell-shaped slot having a first leg opening at said side and a second leg transverse to said first leg and spaced from said side, and each pin means includes a pin attached to said support means and received by said ell-shaped slot in retainable relation and another aspect to provide that the mounting frame includes a ball detent entering said second leg to retain said pin.

It is still another aspect of this invention to provide that each adjustment means includes pivot means mounted to said support means and an elongate screw received by said pivot means in threadedly adjustable relation, said screw having a remote end engageable with said mounting frame, and another aspect to provide that said mounting frame includes a recess receiving said remote end of said screw.

It is yet another aspect of this invention to provide a support member attached to the support means is disposed below each mounting frame and engageable with the mounting frame to carry the weight of the secondary roll when said roll is swung away from the primary roll.

An aspect of this invention is to provide that each mounting frame includes handle means to pull the mounting frames rearwardly.

Another aspect of this invention is to provide that one of said secondary roll journal ends includes a driven gear disposed inwardly of an adjacent mounting frame.

It is an aspect of this invention to provide a mounting assembly for a meter roll which is simple and inexpensive to manufacture and effective in operation.

BRIEF DESCRIPTION OF THE DRAWINGS:

FIG. 1 is an end view of a printing press showing a roll arrangement;

FIG. 2 is a cross-sectional view taken through line 2—2 of FIG. 1 showing one end of the meter roll and associated mounting frame;

FIG. 3 is a fragmentary plan view of the meter roll and mounting frame;

FIG. 4 is a cross-sectional view taken on line 4—4 of FIG. 2;

FIG. 5 is a cross-sectional view taken on line 5—5 of FIG. 2, and

FIG. 6 is a cross-sectional view taken on line 6—6 of FIG. 2.

DESCRIPTION OF THE PREFERRED EMBODIMENT:

Referring now by reference numerals to the drawing and first to FIG. 1 it will be understood that the printing press generally indicated by numeral 10 includes an operator side sideframe 12 and a gearside sideframe 14 which support a plurality of rolls. In the embodiment shown the rolls are respectively a meter roll 16, an anilox roll 18 and an impression roll 20. This invention is concerned with the mounting of the meter roll 16, which consitutes a secondary roll, so that it can be readily removed to provide access to and removal of the anilox or ink roll 18, which constitutes a primary roll.

As clearly shown by reference to the drawings the meter roll 16 includes opposed end journals 22 and 24 which differ from each other in that end journal 22 is provided with a gear 26 which is fixedly attached to said journal and is engageable with a drive gear 28 of the anilox roll 18 which is fixedly attached to said anilox roll 18. It will be particularly noted that gears 26 and 28 are attached to the meter roll and the anilox roll drive journal respectively adjacent the inside face of gearside sideframe 14. The mounting assembly of the meter roll 16 is essentially the same at each journal end and will therefore be described with reference to journal 24 it being understood that, except as described, the meter roll is essentially symmetrical so that the mounting assemblies at each end are in mirror image of each other.

The meter roll mounting assembly, generally indicated by numeral 30 in FIGS. 2 and 3, includes generally rectangular mounting frames in the form of plates 32 which each includes upper and lower sides 34 and 36 and forward and rearward sides 38 and 40. The upper forward corner, as indicated by 42 is cut away in order to avoid the anilox roll journal assemblies (not shown). As shown in FIG. 5 the mounting plate 32 includes an opening 44 receiving the outer ring of ball race 46 in tight fit relation, said ring being held against outer axial movement by a snap ring 48. The inner ring of the ball race 46 is similarly held in tight fit relation on the roll journal 24 and being held against inner axial movement by a snap ring 50. The overall distance between the outer faces 52 of the rectangular mounting plate 32 and the overall distance between the inner faces 54 of the sideframes 12 and 14 is such that the mounting plates 32 carrying the ball races 46 and meter roll 16, can slide relative to said sideframes.

Each mounting plate 32 is attached to its respective sideframe by a pivot pin 60 and cooperating counterbalance screw 62 constituting an adjustment means. As shown in FIG. 4, the pin 60 is fixedly attached to the sideframe inside face 54. In the embodiment shown the pins 64 are straight pins such as those manufactured under the trademark Driv-Lok by Driv-Lok, Inc. of Sycamore, Ill. The mounting plate 32 includes a substantially ell-shaped slot 68 which is sized to receive the pin 60 and includes a first, vertical leg 67 and a second, horizontal leg 69, said pin being received by the semicircular rearward end of said leg 69. The mounting plate 32 also includes a threaded opening 70 which receives a threaded member 72 having a ball detent 73 which acts to retain the pin 60 within the slot 68 while permitting swinging movement of said mounting plate about said pin 60. The counterbalance screw 62 is pivotally mounted to the sideframe 12 by means of a pin 74 which, as shown in FIG. 6, includes a shank 76, received within a sideframe opening 78 and held by a detent 80, and a head 82 having a threaded opening 84 receiving the counterbalance screw 62 in adjustable relation. The counterbalance screw 62 includes a remote end 86, which is engageable within a recess 88 provided on the rearward side 40 of the mounting plate 32, and said screw includes at its outer end a head 89 to facilitate turning the screw.

It will be understood that the weight of the roll 16 acts at the axis of rotation of the roll. The weight is transferred to the forward or first portion of the mounting plate 32 and tends to swing said plate about the pivot axis defined by the pin 60 which is located at the rearward or second portion of the mounting plate 32. In somewhat simplified terms the tendency of the mounting plate 32 to swing about the pin 60 results in a turning moment which initially is $W \times L$, where W is the weight of the roll and L is the horizontal distance between the axis of the roll 16 and the pivot axis of the pin 60. The swinging tendency is counterbalanced by the resistance moment PD, where P is the resistance provided by the counterbalance screw 62 and D is the tangential distance between the longitudinal axis of the screw 62 and the pivot axis of the pin 60.

As will be readily understood by reference to FIG. 2, the backing off of the counterbalance screw 62 results in the forward end of the mounting plate 32 being lowered as it is swung about pin 60 until it engages support pins in a rest position 90, as shown in phantom outline in FIG. 2, said pin being one of three (3) support pins 90, 92 and 94 outstanding from sideframe 12, which are straight pins such as Driv-Lok pins, connected to said sideframe. This will provide sufficient clearance to remove the anilox roll 18. When it is desired to remove the meter roll 16 for replacement or repair it is simply a matter of backing off the counterbalance screws 62 until the remote end is disengaged from the recess 88 and pivoting said counterbalance screws out of the way and pulling pins 74, with the screws, clear of the sideframes. When this is done the ball detents 72 can be overriden to permit relative movement of pin 60 in the slot 68. Then by grasping the handles 96, which can also be straight pins, the operator can pull the mounting plates 32 together with the roll 16 rearwardly sufficiently to provide relative movement of the horizontal portions 69 of the ell-shaped slots 68 so that the pins 60 are aligned to enter the vertical portions 67 of said slots. The mounting plates 32 can then be lowered onto the adjacent pins 92, which are disposed below said plate sufficiently for the pins 60 to clear said slot vertical portions, at which time the combined roll, gear and mounting plate assembly can be pulled clear utilizing said support pins 92 and 94. As will be readily understood the entire procedure can be reversed to replace the combined roll, gear and mounting assembly. It will also be understood that the counterbalance screws 62, by applying pressure to the mounting plates 32 control the pivoting of said plates and provides a means of accurately adjusting the engagement pressure of the meter roll 16 relative to the anilox roll 18.

In view of the above it will be understood that various aspects and features of the invention are achieved and other advantageous results are attained. While a preferred embodiment of the invention has been shown and described, it will be clear to those skilled in the art that various modifications may be made without departing from the invention in its broader aspect.

We claim as our invention:

1. In a roll assembly in which a primary roll is mounted for engagement by a secondary roll having an axis of rotation parallel to the axis of rotation of the primary roll, a secondary roll mounting assembly comprising:

a secondary roll having opposed journal ends, opposed side support means at each end of said secondary roll, opposed mounting frames each including bearing means receiving an associated journal end, pin means and cooperating slot means respectively pivotally mounting each mounting frame of said mounting frames to an associated support means of said side support means in spaced relation from said bearing means, one of said pin means and slot means being provided by the respective mounting frame and the other of said pin means and slot means being provided by the associated support means, said pin means being disengageable from said slot means to remove each said mounting frame from said associated support means, and adjustment means including a threadedly adjustable screw between each said associated support means and each respective said mounting frame disposed in spaced relation from said pin means to apply pressure to said mounting frame and control pivoting of said mounting frame about said pin means to swing said secondary roll about said pin means toward and away from said primary roll, said opposed mounting frames and said journal ends being entirely disposed inwardly of said opposed side support means so as to facilitate removal of said mounting frames and said secondary roll as a unit from between the opposed side support means.

2. In a roll assembly in which a primary roll is mounted for engagement by a secondary roll having an axis of rotation parallel to the axis of rotation of the primary roll, a secondary roll mounting assembly comprising:

(a) a secondary roll having opposed journal ends, (b) opposed side support means at each end of said secondary roll, (c) opposed mounting frames each including bearing means receiving an associated journal end, (d) pin means and cooperating slot means respectively pivotally mounting each mounting frame of said mounting frames to an associated support means of said side support means in spaced relation from said bearing means, one of said pin means and slot means being provided by the respective mounting frame and the other of said pin means and slot means being provided by the associated support means, said pin means being disengageable from said slot means to remove each said mounting frame from said associated support means, and (e) adjustment means between each said associated support means and each respective said mounting frame disposed in spaced relation from said pin means to apply pressure to said mounting frame and control pivoting of said mounting frame about said pin means to swing said secondary roll about said pin means toward and away from said primary roll, each mounting frame including a side and the slot means including an ell-shaped slot having a first leg opening at said side and a second leg transverse to said first leg and spaced from said side, and each pin means including a pivot pin attached to said support means and received by said ell-shaped slot in retainable relation.

3. An assembly as defined in claim 1, in which:

each adjustment means pivot means mounted to said support means and said adjustable screw is elongate and is received by said pivot means in threadedly adjustable relation, said screw having a remote end engageable with said mounting frame.

4. In a roll assembly in which a primary roll is mounted for engagement by a secondary roll having an axis of rotation parallel to the axis of rotation of the primary roll, a secondary roll mounting assembly comprising:

a secondary roll having opposed journal ends, opposed side support means at each end of said secondary roll, opposed mounting frames each including bearing means receiving an associated journal end, pin means and cooperating slot means respectively pivotally mounting each mounting frame of said mounting frames to an associated support means of said side support means in spaced relation from said bearing means, one of said pin means and slot means being provided by the respective mounting frame and the other of said pin means and slot means being provided by the associated support means, said pin means being disengageable from said slot means to remove each said mounting frame from said associated support means, adjustment means between each said associated support means and each respective said mounting frame disposed in spaced relation from said pin means to apply pressure to said mounting frame and control pivoting of said mounting frame about said pin means to swing said secondary roll about said pin means toward and away from said primary roll, and a support member attached to the support means being disposed below each mounting frame and engageable with the mounting frame to carry the weight of the secondary roll when said roll is swung away from the primary roll.

5. An assembly as defined in claim 4, in which:

each mounting frame includes a handle means to pull the mounting frames rearwardly.

6. In a roll assembly in which a primary roll is mounted for engagement by a secondary roll having an axis of rotation parallel to the axis of rotation of the primary roll, a secondary roll mounting assembly comprising:

a secondary roll having opposed journal ends, opposed side support means at each end of said secondary roll, opposed mounting frames each including bearing means receiving an associated journal end, and pin means and cooperating slot means respectively pivotally mounting each mounting frame of said mounting frames to an associated support means of said side support means in spaced relation from said bearing means, one of said pin means and slot means being provided by the respective mounting frame and the other of said pin means and slot means being provided by the associated support means, said pin means being disengageable from said slot means to remove each said mounting frame from said associated support means, and adjustment means between each said associated support means and each respective said mounting frame disposed in spaced relation from said pin means to apply pressure to said mounting frame and control pivoting of said mounting frame about said pin means to swing said secondary roll about said pin means toward and away from said primary roll, each mounting frame being generally rectangular to include upper and lower sides and forward and rearward sides, and the slot means including an ell-shaped slot having a first leg opening at said upper side and a second leg transverse to said first leg and spaced from said upper side, each pin means including a pivot pin attached to said support means and received by said second leg in retainable relation, and each adjustable means including a pivot means mounted to said support means and an elongate screw received by said pivot means in threadedly adjustable relation, said screw having a remote end engageable within a recess provided in said rearward side of said mounting frame.

7. An assembly as defined in claim 6, in which:

a support pin attached to the support means is disposed below each mounting frame and engageable with the lower side of said frame to carry the weight of the secondary roll when said roll is swung away from the primary roll.

8. An assembly as defined in claim 7, in which:

each mounting frame includes an inwardly extending handle to facilitate pulling said frames rearwardly relative to the pivot pins and to lower the mounting frames relative to said pivot pins to disengage said mounting frames from said pins, and pull said secondary roll clear of said support means.

9. An assembly as defined in claim 8, in which:

each mounting frame upper side is threaded to receive a ball detent entering the second leg of the ell-shaped slot to retain said pivot pin in said slot.

10. In a roll assembly in which a primary roll is mounted for engagement by a secondary roll having an axis of rotation parallel to the axis of rotation of the primary roll, a secondary roll mounting asssembly comprising:

a secondary roll having opposed journal ends, opposed side support means at each end of said secondary roll, opposed mounting frames each including bearing means receiving an associated journal end, pin means and cooperating slot means respectively pivotally mounting each mounting frame of said mounting frames to an associated support means of said side support means in spaced relation from said bearing means, one of said pin means and slot means being provided by the respective mounting frame and the other of said pin means and slot means being provided by the associated support means, said pin means being disengageable from said slot means to remove each said mounting frame from said associated support means, and adjustment means between each said associated support means and each respective said mounting frame disposed in spaced relation from said pin means to apply pressure to said mounting frame and control pivoting of said mounting frame about said pin means to swing said secondary roll about said pin means toward and away from said primary roll, one of said secondary roll journal ends including a fixedly attached driven gear disposed inwardly of an adjacent mounting frame, said opposed mounting frames and said journal ends being entirely disposed inwardly of said opposed side support means so as to facilitate removal of said mounting frames and said secondary roll as a unit from between the opposed side support means.

* * * * *

UNITED STATES PATENT AND TRADEMARK OFFICE

CERTIFICATE OF CORRECTION

PATENT NO. : 4,942,815

DATED : July 24, 1990

INVENTOR(S) : Greer et al.

It is certified that error appears in the above-identified patent and that said Letters Patent is hereby corrected as shown below:

Column 5, line 29, delete "(a)"
line 30, delete "(b)"
line 32, delete "(c)"
line 34, delete "(d)"
line 45, delete "(e)"
line 61, after "means", (1st Occur.) insert --includes--.

Signed and Sealed this

Fourth Day of August, 1992

*Attest:*

DOUGLAS B. COMER

*Attesting Officer*

*Acting Commissioner of Patents and Trademarks*